United States Patent [19]

Gavagan

[11] 4,392,280

[45] Jul. 12, 1983

[54] CLEVIS SAFETY BELT BUCKLE

[75] Inventor: James A. Gavagan, Centerline, Mich.

[73] Assignee: Irvin Industries, Inc., Madison Heights, Mich.

[21] Appl. No.: 229,883

[22] Filed: Jan. 30, 1981

[51] Int. Cl.[3] ..... A44B 11/26

[52] U.S. Cl. ..... 24/230 A

[58] Field of Search ..... 24/230 A, 230 AK, 230 AL, 24/230 AP

[56] References Cited

U.S. PATENT DOCUMENTS

| | | | |
|---|---|---|---|
| 3,897,611 | 8/1975 | Booth et al. | 24/230 AL X |
| 4,033,015 | 7/1977 | Uwe et al. | 24/230 AL |
| 4,228,567 | 10/1980 | Ikesue et al. | 24/230 AL |
| 4,313,246 | 2/1982 | Föhl | 24/230 A X |
| 4,358,877 | 11/1982 | Burke | 24/230 AP X |

*Primary Examiner*—Robert P. Swiatek

[57] ABSTRACT

A high strength safety belt buckle characterized by a clevis attached to one belt end, a connector attached to another belt end releasably held within the clevis by a latch passing through the connector and engaging both sides of the clevis. A first embodiment is suitable for use as a safety release buckle in a passive restraint system which need be disconnected only under emergency conditions. A second embodiment is suitable for normal safety belt buckle use where maximum convenience of connection and disconnection is essential.

17 Claims, 28 Drawing Figures

CLEVIS SAFETY BELT BUCKLE

BACKGROUND OF THE INVENTION

Known prior art safety belt buckles are disclosed in the following U.S. Pat. Nos.: 3,131,451; 3,237,256; 3,242,546; 3,274,655; 3,277,548; 3,449,800; 3,465,393; 3,483,599; 3,588,969; 3,623,191; 3,639,951; 3,686,720; 3,716,895; 4,015,094; 4,052,775; 4,060,879; 4,064,603. Additional prior art includes a safety belt buckle disclosed in co-pending United States Patent Application Ser. No. 06/161,424 filed on June 20, 1980. A common feature of such prior art buckles is a connector constructed as a flat metal tongue having an aperture slot for engagement by a latch projection spring loaded to an engagement position and having a ramp surface for deflecting the latch upon introduction of the tongue and deflected by a push button for disengagement. The latch projection is commonly provided on a pivoted element anchored in the buckle housing which is under compression from separating stress applied to the buckle and accordingly subject to bending stress limiting the effective strength of the connection under crash loading.

SUMMARY OF THE PRESENT INVENTION

Embodiments of the present invention disclosed herein employ a clevis haivng side apertures extending over the aperture in the connector tongue and a latch projection which extends through the tongue aperture and seats on both sides of the clevis to provide a latch connection subject to close coupled compressive shear stresses which are transmitted through primary tensile stresses in the connector and clevis members to the associated belt connections. Such inherently stronger latch construction has made it possible to achieve the surprising result of a 6,500 pound separating test load without damage in a buckle of substantially the same size and proportions as the standard prior art buckle having a capacity of only a fraction of such test load.

In a first embodiment suitable for a semi-permanent buckle connection, as in a passive system wherein the buckle is manually opened only under emergency conditions, the initial connection as well as disconnection is made with a manual push button depressed. In a second embodiment provision is made for deflecting the latch to accommodate insertion of the connector tongue without need for depressing the push button thereby providing an insertion feature completely equivalent to conventional prior art buckles which facilitate buckle connection made through mere insertion of the connector tongue.

Figure 1:
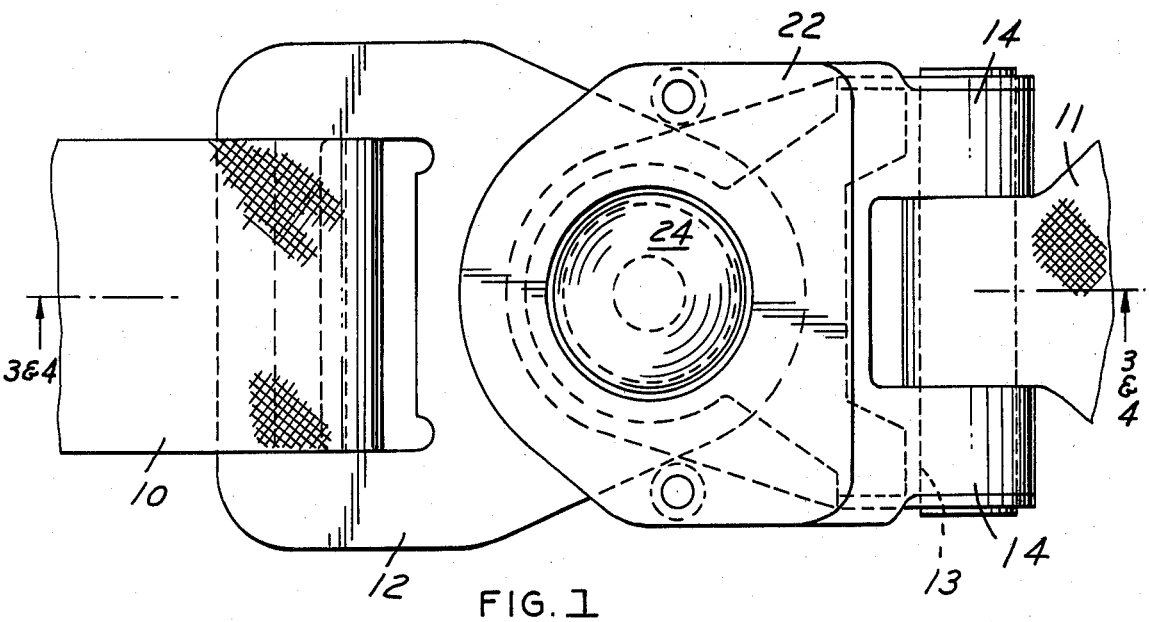
FIG. 1 is a plan view of the first embodiment of the invention.
Figure 2:
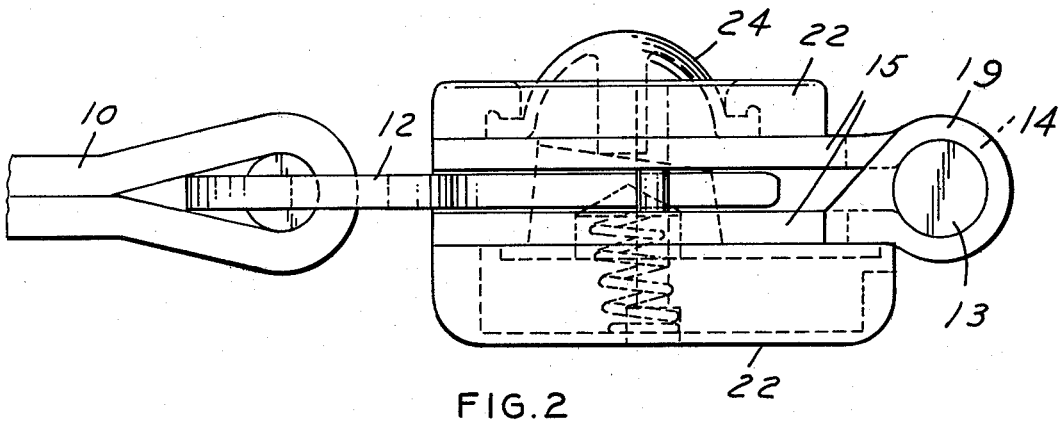
FIG. 2 is a side elevation of the first embodiment.
Figure 6:
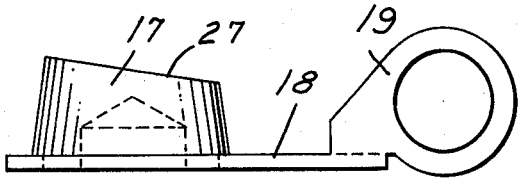
FIG. 6 is a side elevation of the latch hinge.
Figure 3:
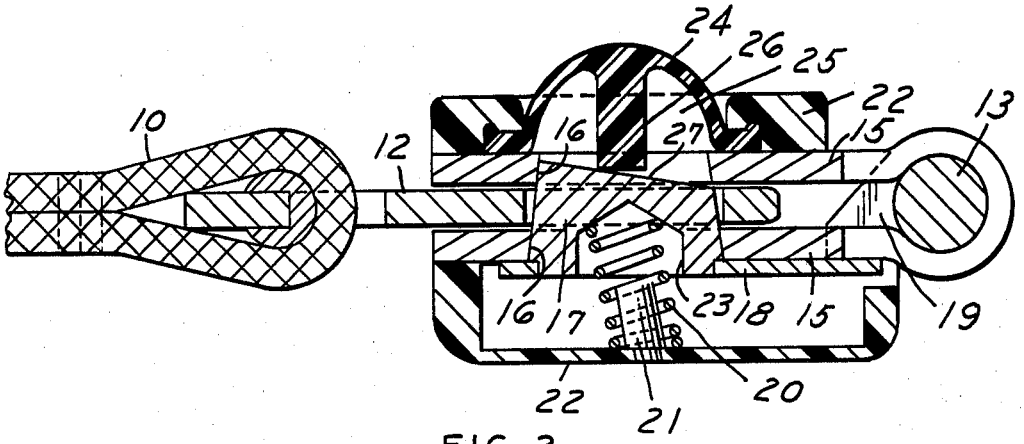
FIG. 3 is a sectional view taken along the line 3—3 of FIG. 1 showing the buckle latched.
Figure 4:
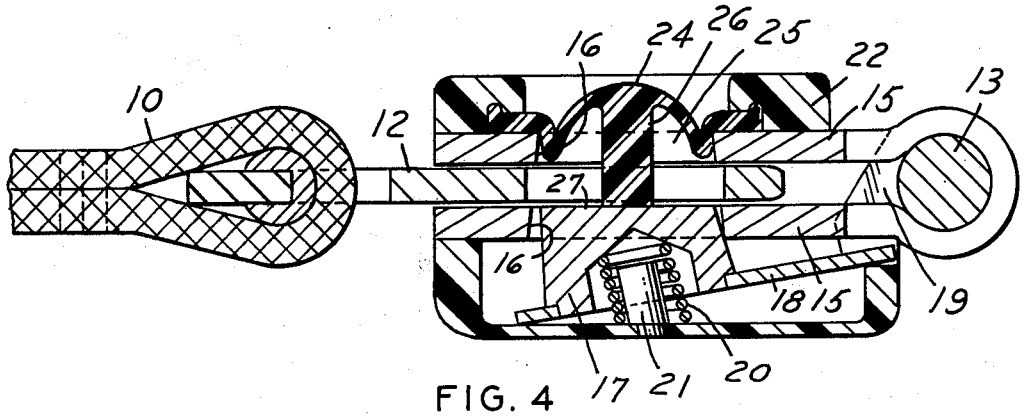
FIG. 4 is a sectional view taken along the line 4—4 of FIG. 1 showing the buckle with the push button depressed.
Figure 5:
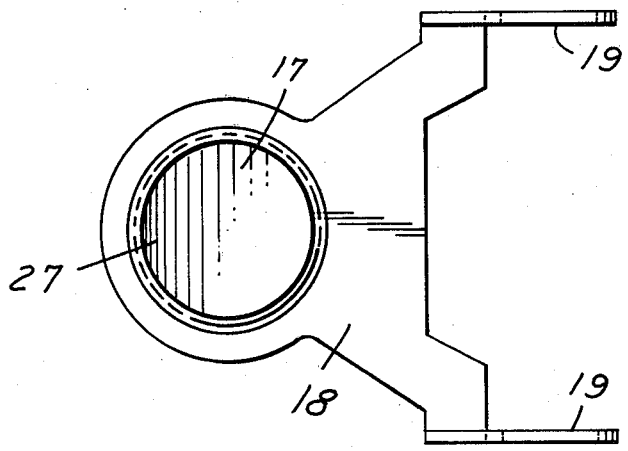
FIG. 5 is a plan view of the latch hinge employed in the buckle illustrated as the first embodiment.

With reference to the embodiment of FIGS. 1 to 6, fabric belt ends 10 and 11 are attached by conventional means respectively to connector tongue 12 and cylindrical pin 13 extending through spaced ends 14 of clevis 15 having conically tapered apertures 16 formed to seat latch 17 which, as best shown in FIG. 3, is constructed as the frustum of a cone seated by a press fit on hinge 18 having integral ears 19 pivoting on cylindrical pin 13. Coiled compression spring 20 piloted on locator pin 21 seated in cover 22 engages spring pocket 23 urging latch 17 into seated position as shown in FIG. 3. Resilient rubber push button 24 seated on clevis 15 within aperture 25 in cover 22 has a central projection 26 engageable with tapered planar surface 27 at the top of latch 17 providing a push button means to manually depress latch 17 to the release position shown in FIG. 4 where surface 27 of latch 17 retracts within the lower aperture 16 providing clearance for partial retraction of connector tongue 12, whereupon release of push button 24 will permit complete retraction to disengage the buckle.

To engage the buckle, depression of push button 24 will likewise permit partial insertion of connector tongue 12 up to projection 26 following which release of the push button will permit completion of insertion to the point where spring 20 engages latch 17. From the above description and inspection of FIG. 3 it will be understood that the solid metal latch 17 engages both conical aperture surfaces 16 to place both legs of clevis 15 under tensile load as a like tensile load is applied to connector 12. The solid metal construction of conical latch 17 is well able to withstand any tensile load imparted by the respective clevis and connector elements. Thus, no compressive loading on any elongated pivoted latch plate leading to bending loads and failures under high emergency impact is in any way involved in the present buckle. As applied to an emergency release belt connection in a passive restraint system which need be engaged only once upon installation subject to emergency release if necessary at the time of an accident, any inconvenience in requiring depression of the push button for initial engagement is a minor consideration and the simplicity as well as the inherent strength recommends this construction for such installations.

Figure 7:
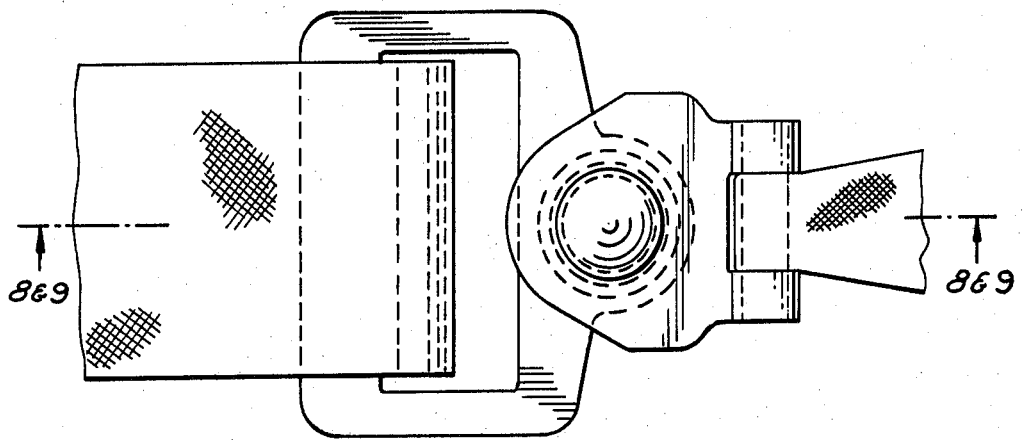
FIG. 7 is a plan view of a somewhat modified version of the first embodiment.
Figure 8:
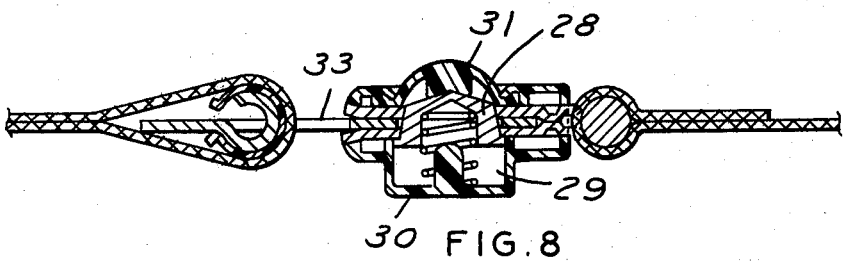
FIG. 8 is a sectional side elevation taken along the line 8—8 of FIG. 7.
Figure 9:
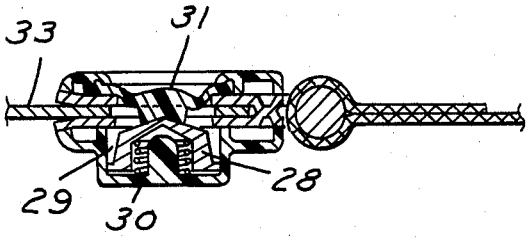
FIG. 9 is a fragmentary sectional view taken along the line 9—9 of FIG. 7 illustrating the latch button in depressed condition.
Figure 10:
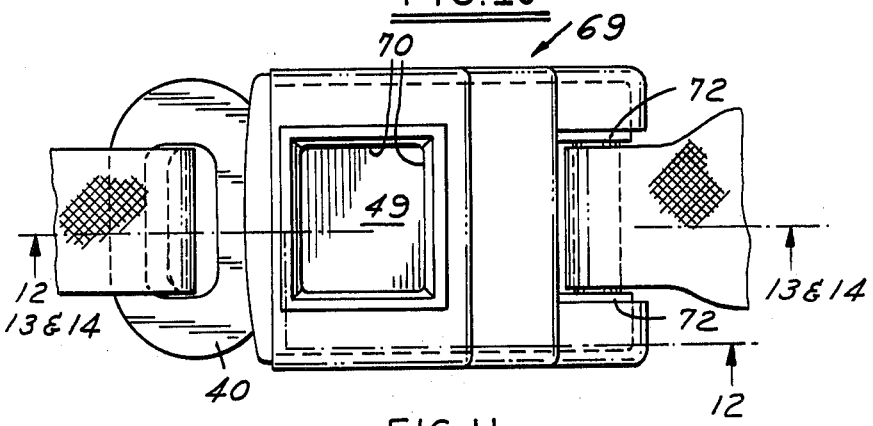
FIG. 10 is a plan view of a second embodiment of the present invention.
Figure 11:
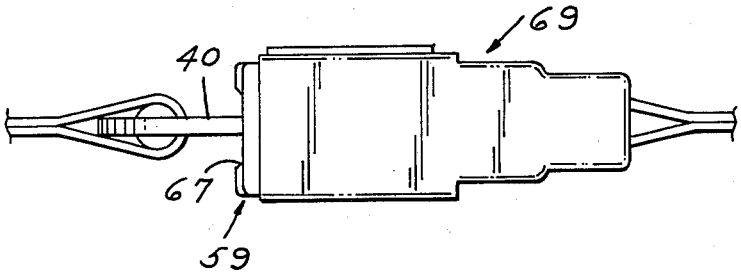
FIG. 11 is a side elevation of the second embodiment.

With reference to FIGS. 7, 8 and 9 a modification of the first embodiment illustrates a still simpler construction dispensing with hinge 18 as a mounting element for modified latch 28 which is directly mounted in recess 29 in modified cover 30 which houses push button 31 adapted to engage an upper shallow conical surface of latch 28 providing required clearance for either insertion or withdrawal of connector tongue 33 when push button 31 is depressed as shown in FIG. 9 in a manner similar to the previously described embodiment.

The latch in both versions of the first embodiment is provided with a conical surface matching the conical tapered apertures in clevis and connector elements. The included angle of the conical surface, such as 10°, is less than the angle of friction for mating surfaces to provide self-locking under load that is sufficiently close to the angle of friction to assist in unlocking under load when the release button is manually depressed. The top surfaces 27 and 32 of the respective latches are beveled sufficiently to provide clearance for partial insertion and withdrawal in the deflected conditions shown in FIGS. 4 and 9. Each of the two versions of the first embodiment has been test loaded to provide a six thousand pound system using a clevis of the proportions shown with 0.067" thickness of clevis stock made of SAE 4130 steel together with a 0.090" thick connector tongue.

Figure 12:
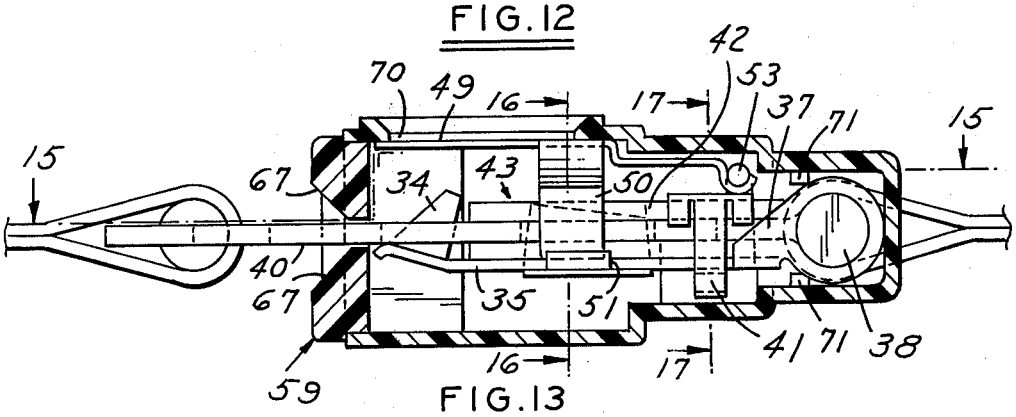
FIG. 12 is an enlarged sectional view taken substantially on the line 12—12 of FIG. 10.
Figure 13:
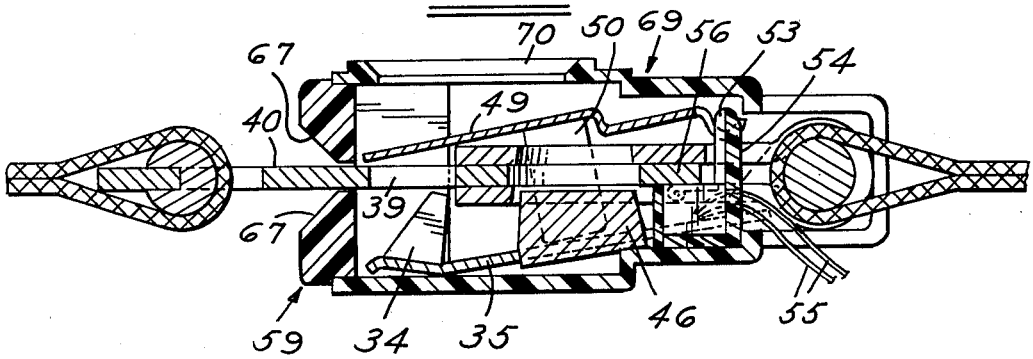
FIG. 13 is a sectional view taken along the line 13—13 of FIG. 10 showing the latch in depressed condition.
Figure 14:
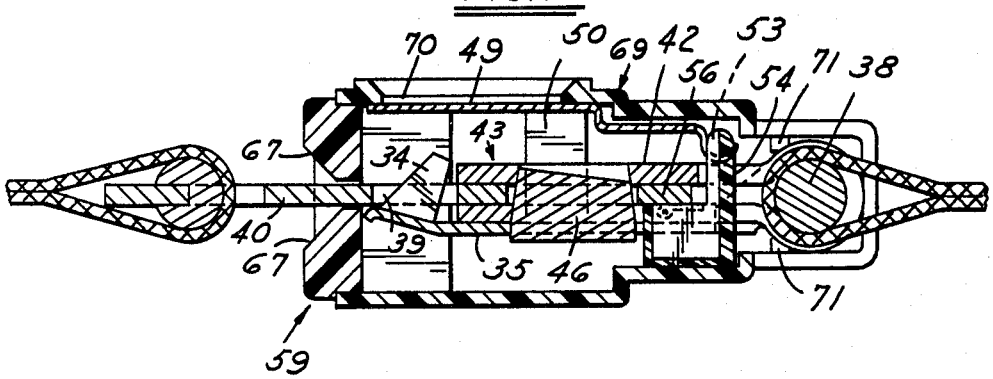
FIG. 14 is a sectional view taken along the line 14—14 of FIG. 10 showing the buckle in latched condition.
Figure 15:
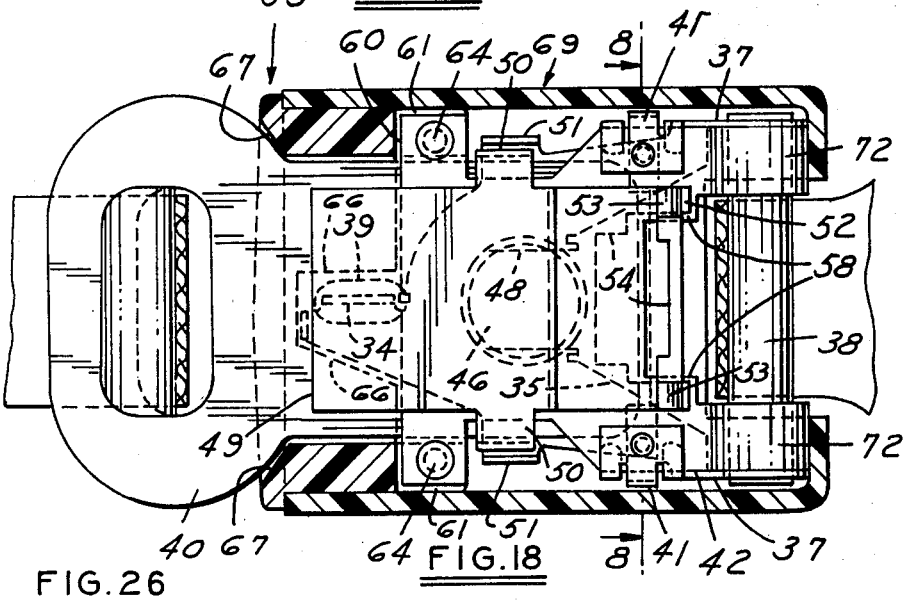
FIG. 15 is a sectional plan view taken along the line 15—15 of FIG. 12.
Figure 26:
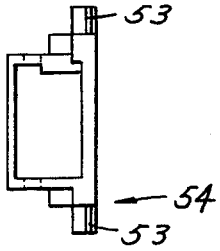
FIGS. 26, 27 and 28 are respectively plan, end and side views of one electrical switch housing employed in the embodiment of FIGS. 10 to 17.
Figure 18:
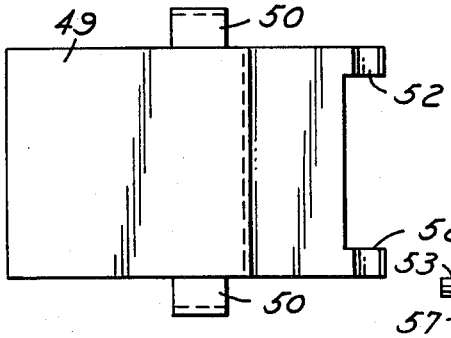
FIG. 18 is a plan view with the push button lever employed in the embodiment of FIGS. 10 to 17.
Figure 16:
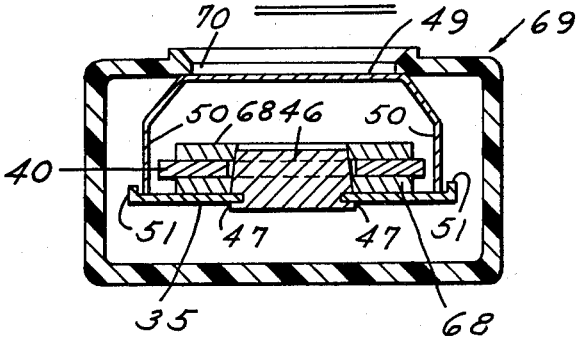
FIG. 16 is a sectional end view taken along the line 16—16 of FIG. 12.
Figure 17:
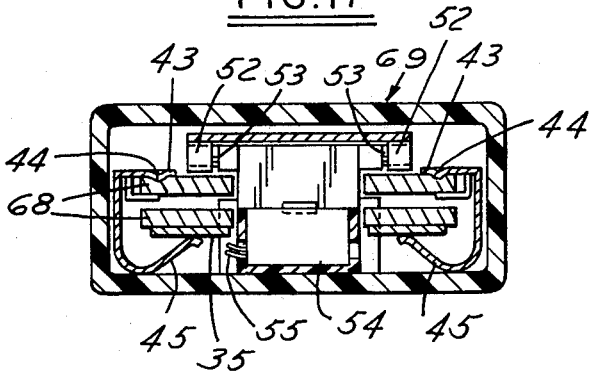
FIG. 17 is a sectional end view taken along the line 17—17 of FIG. 12.

With reference to FIGS. 10 to 28, in order to provide the convenience feature of conventional prior art buckle latches which are automatically deflected to provide engagement upon insertion of the connector tongue without need for manually depressing the release button, the same principle of high load capacity is achieved for a latch engagement of clevis and connector tongue similar to the first embodiment with an added feature of latch deflection responsive to beveled extension 34 and latch hinge 35 pivoted through ears 37 to cylindrical attachment pin 38 and otherwise similar to construction and operation to hinge 18 of the first embodiment. Supplemental slot 39 in connector tongue 40 accommodates the return of latch hinge 35 from a fully deflected position as shown in FIG. 13 to a latch engaging position as shown in FIG. 12 through the action of a pair of spring clips 41 attached to the upper outer edges 42 of clevis 43 retained by a dimpled engagement 44 in spring and clevis surfaces and effective through spring arms 45 shown in FIG. 17 to normally retain latch 46 in fully engaged position as shown in FIGS. 12 and 16. In order to maintain latch 46 in proper orientation side slots 47 are provided to engage retaining margins 48 formed in hinge 35.

Figure 27:
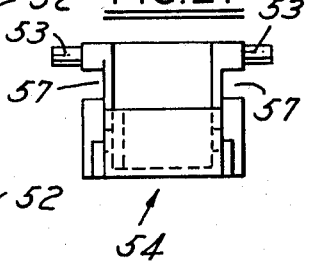
Figure 28:
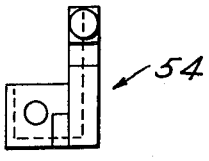
Figure 19:
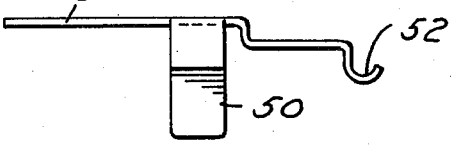
FIG. 19 is a side elevation of the push button lever.
Figure 20:
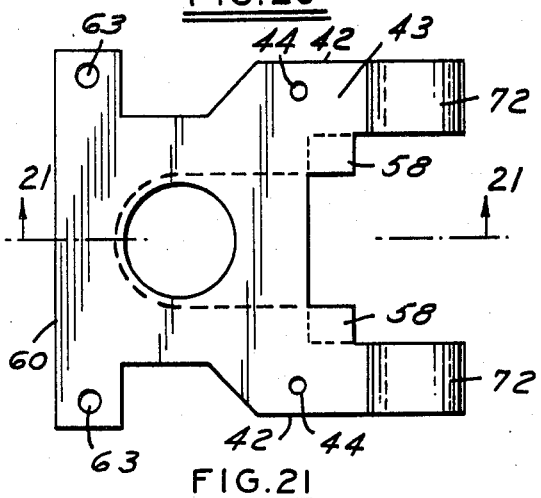
FIG. 20 is a plan view of the clevis employed in the embodiment of FIGS. 10 to 17.
Figure 22:
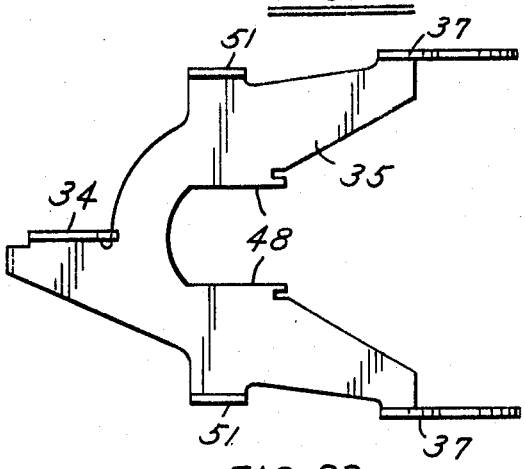
FIG. 22 is a plan view of the latch hinge employed in the embodiment of FIGS. 10 to 17.
Figure 21:
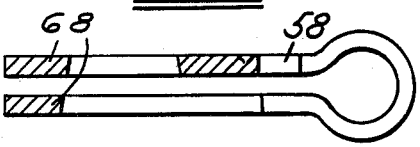
FIG. 21 is a sectional view taken along the line 21—21 of FIG. 20.
Figure 23:
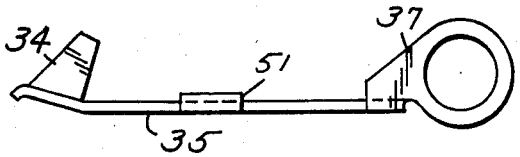
FIG. 23 is a side elevation of the latch hinge of FIG. 22.

As best shown in FIGS. 12, 15, 18 and 19, release lever 49 is formed as a stamping having side projections 50 projecting down to engage hinge 35 between its upwardly projecting locating ears 51. Release lever 49 having arcuate extension fingers 52 engaging annular projections 53 in plastic switch housing 54, shown per se in FIGS. 26, 27 and 28, accommodating switch wires 55 which provide a circuit closed by forward end 56 of connector 40. With reference to FIG. 27 slots 57 in switch housing 54 engage corner projections 58 of clevis 43 shown in FIGS. 20 and 21 to provide a fixed pivot fulcrum for release lever 49.

Figure 24:
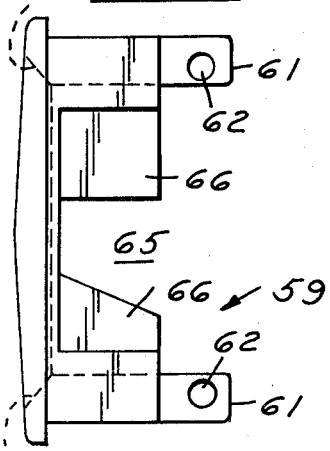
FIG. 24 is a plan view of the connector guide employed in the embodiment of FIGS. 10 to 17.
Figure 25:
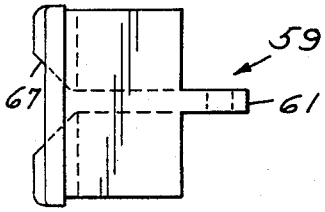
FIG. 25 is a side elevation of the connector guide of FIG. 24.

Plastic guide 59, illustrated per se in FIGS. 24 and 25, is secured to the end 60 of clevis 43 by projections 61 having holes 62 corresponding to clevis holes 63 for suitable attachment screws or rivets 64. Guide 59 is recessed at 65 to accommodate tapered cam projection 34 of hinge 35 and is recessed above guide surfaces 66 to accommodate depression of release lever 49. Tapered guide surfaces 67 assist in locating the nose of connector 40 for insertion between spaced sides 68 of clevis 43.

Cover 69 is provided with square opening 70 exposing lever 49 for thumb depression to release the latch. Retention projections 71 of cover 69 engage adjacent surfaces 72 of clevis 43 when the assembled latch with guide 59 secured thereto is inserted through the end of the cover and pressed into the position shown in FIGS. 12 and 14.

In the above described embodiments the clevis is formed as an integral unit by bending steel strip stock, having a central opening stamped out to accommodate fabric belt attachment, with arcuate sides to accommodate cross pin insertion. As an alternate construction the clevis strength can be provided in a substantially equivalent manner by fabrication of two pieces of like strip stock slotted at the ends for belt attachment with suitable provision for radiused engagement at the loop end of the fabric belt.

With regard to the engaging surfaces of the latch with clevis and connector apertures, conical configuration of aligned clevis apertures matching the conical surface of the latch pin has been illustrated in the respective embodiments which may be theoretically optimum for minimizing unit compressive stress at the engaging surfaces under high belt loading. Nevertheless as a practical matter it has been found satisfactory and in some respects preferable to construct the clevis apertures as well as the connector aperture as cylindrical holes of the same diameter as the base of the latch pin cone. In using such alternative construction the latch pin is provided with a 10° included angle and polished conical surface at Rockwell C-50 for minimizing friction. A lower hardness such as Rockwell C-38 is provided for the clevis and connector in order to avoid brittle fractures and allow mating surfaces of both clevis and connector to "Brinell" or yield in compressive contact with the harder latch and conform to its smooth surface. This approach avoids any tolerance problems in manufacturing which might allow the forward edge of the latch to contact and hang up on the underside of the top hole in the celvis causing a "false latch" condition with only one-half of the clevis engaged. With the two holes of equal diameter and reamed to provide accurate alignment as well as equal size, any such false latching is geometrically impossible. In samples tested to 6,000 pounds it was found that at a 600 pound load the latch pin leaned sufficiently to contact the edge of the upper hole and, after the maximum load was released, the latch returned to its original position with no permanent set in the latch carrier. With the latch hinged as shown there is always more clearance at the top hole than at the bottom and any misengagement is accordingly impossible.

From the foregoing description of both embodiments it will be understood that the same clevis latch engagement of the connector is accomplished; however, with a convenience feature of automatic latching upon insertion of the connector tongue being provided by the second embodiment of FIGS. 10 to 28.

I claim:

1. A safety belt buckle comprising a connector tongue adapted for attachment to a first belt end, a housing having a base, clevis means mounted within said housing extending, longitudinally as an aligned tension element on both sides of said tongue with a transverse closed end adapted for attachment to a second belt end, alignable apertures in said connector tongue and both adjacent sides of said clevis means, latch means extending upwardly from the base through said apertures engaging said tongue and both sides of said clevis means, resilient means mounted within said housing normally retaining said latch means in engaging position, and exposed manually actuable means for moving said latch means downwardly relative to both clevis and tongue to a position for disengaging said connector tongue.

2. A safety belt buckle as set forth in claim 1 wherein said latch means comprises a male element matching both aperture contours of said clevis means in the area of latch loading under belt tension.

3. A safety belt buckle as set forth in claim 2 wherein said latch means also matches said connector tongue aperture in the area loaded under belt tension.

4. A safety belt buckle as set forth in claim 1 wherein engaging areas of said latch means loaded under belt tension extend in a surface oblique to the direction of tension applied to said connector tongue and clevis means under tensile belt loading, said oblique surface favoring the manual movement of said latch means in effecting disengagement under load while comprising a self-locking angle which will not permit disengagement without manual actuation of said means for moving said latch means.

5. A safety belt buckle as set forth in claim 4 wherein the surface of said latch means having belt loaded contact with said connector tongue extends at an oblique angle relative to the direction of tension under belt pull, said oblique angle favoring disengaging movement of said latch means under load but comprising a self-locking angle requiring manual actuation of said means for moving said latch to effect disengagement under belt load.

6. A safety belt buckle as set forth in any of claims 1–5 wherein said connector tongue and clevis means are both constructed of flat metal strip material dimensioned for close free fit of said connector tongue between adjacent sides of said clevis means.

7. A safety belt buckle as set forth in claim 6 wherein said clevis means is constructed from a single piece of flat metal strip stock bent through 180° to form adjacent sides.

8. A safety belt buckle as set forth in claim 7 wherein the bent end of said clevis means is formed to receive a transverse connector pin.

9. A safety belt buckle as set forth in claim 8 wherein said formed clevis end has a central open portion, a connector pin extending across said open central portion engaging the remaining spaced ends of said clevis means, and said second belt end engaging the exposed central portion and said connector pin to provide a load bearing belt connection.

10. A safety belt buckle as set forth in claim 6 wherein said latch means comprises a generally frustum shaped conical element having a truncated top surface and an axis substantially normal to the direction of tension under belt load.

11. A safety belt buckle as set forth in claim 10 wherein the truncated surface of said conical element is constructed to provide minimal clearance for withdrawal of said connector tongue when manually moved to a disengagement position.

12. A safety belt buckle as set forth in claim 11 including pivotal hinge means in said housing on which said conical latch element is mounted, said truncated surface comprising a planar surface extending substantially parallel to the adjacent surface of said connector tongue during disengagement of said connector tongue.

13. A safety belt buckle as set forth in claim 12 including cam means associated with said hinge means engageable by said connector tongue to deflect said latch element to said parallel position for admitting insertion of said connector tongue to a latched position without the necessity for employing said manually actuable means.

14. A safety belt buckle as set forth in claim 12 wherein said manually actuable means engages a limited portion of said truncated surface accommodating partial insertion of said connector tongue upon manual actuation to move said planar surface to said parallel position and to thereafter admit full insertion of said connector tongue to a latching position upon release of said manually actuable means to a non-blocking position.

15. A safety belt buckle as set forth in claim 14 wherein said limited engagement of said truncated surface accommodates partial withdrawal of said connector tongue to a position for maintaining said planar surface in said parallel condition upon release of said manually actuable means to a non-blocking position permitting completion of withdrawal of said connector tongue.

16. A safety belt buckle as set forth in claim 11 including means for mounting said conical latch element for substantially axial movement between engaged and disengaging positions, said truncated surface including a bevel accommodating partial withdrawal of said connector tongue upon manual actuation of said means for moving said latch means and to accommodate complete withdrawal of said connector tongue upon release of said manually actuable means.

17. A safety belt buckle as set forth in claim 16 wherein said truncated surface is also provided with an oppositely beveled surface for accommodating partial insertion of said connector tongue upon manual actuation of said means for moving said latch means and for accommodating completion of insertion to a latching position upon release of said manually actuable means.

* * * * *

UNITED STATES PATENT AND TRADEMARK OFFICE

Certificate

Patent No. 4,392,280 Patented July 12, 1983

James A. Gavagan

Application having been made by James A. Gavagan, the inventor named in the patent above identified, and Irvin Industries, Inc., the assignee, for the issuance of a certificate under the provisions of Title 35, Section 256, of the United States Code, adding the name of William E. Brennan as a joint inventor, and a showing and proof of facts satisfying the requirements of the said section having been submitted, it is this 9th day of Oct., 1984, certified that the name of the said William E. Brennan is hereby added to the said patent as a joint inventor with the said James A. Gavagan.

Fred W. Sherling,
*Associate Solicitor.*